US008998042B2

(12) United States Patent
Hague et al.

(10) Patent No.: US 8,998,042 B2
(45) **Date of Patent: *Apr. 7, 2015**

(54) LIQUID DISPENSNG CONTAINER AND METHOD

(71) Applicant: Diversey, Inc., Sturtevant, WI (US)

(72) Inventors: Barry Hague, South Yorkshire (GB); David J. Holden, Derbyshire (GB)

(73) Assignee: Diversey, Inc., Sturtevant, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/186,564

(22) Filed: Feb. 21, 2014

(65) Prior Publication Data

US 2014/0224844 A1 Aug. 14, 2014

Related U.S. Application Data

(63) Continuation of application No. 13/574,728, filed as application No. PCT/US2011/023223 on Jan. 31, 2011, now Pat. No. 8,662,358.

(60) Provisional application No. 61/300,754, filed on Feb. 2, 2010.

(51) Int. Cl.
*B67D 3/00* (2006.01)
*B65D 47/32* (2006.01)

(52) U.S. Cl.
CPC ..... *B65D 47/32* (2013.01)

(58) Field of Classification Search
USPC ..... 222/481, 481.5, 482, 478, 185.1, 94, 222/484; 215/11.3, 11.5
See application file for complete search history.

(56) References Cited

U.S. PATENT DOCUMENTS

| | | | | |
|---|---|---|---|---|
| 154,367 | A | 8/1874 | Birgler | |
| 1,054,146 | A | 2/1913 | Smirle | |
| 1,190,586 | A | 7/1916 | Robertson | |
| 2,286,797 | A | 6/1942 | Duerme | |
| 2,673,013 | A | 3/1954 | Hester | |
| 2,825,479 | A * | 3/1958 | Litzie | 215/11.5 |

(Continued)

FOREIGN PATENT DOCUMENTS

| | | |
|---|---|---|
| EP | 0557913 | 9/1993 |
| EP | 0816247 | 1/1998 |

(Continued)

OTHER PUBLICATIONS

EP11740238.8 Supplementary European Search Report dated Jan. 9, 2014 (6 pages).

(Continued)

*Primary Examiner* — J. Casimer Jacyna
*Assistant Examiner* — Randall Gruby
(74) *Attorney, Agent, or Firm* — Michael Best & Friedrich LLP

(57) ABSTRACT

A liquid dispenser includes a container having an interior adapted to hold a fluid. An air vent is coupled to the container, and a balloon is disposed in the container and in fluid communication with the air vent to provide selective fluid communication between the interior and an exterior of the container, the balloon movable from an undeployed state to a deployed state, and the balloon in the deployed state having a position in which the balloon establishes fluid communication between the exterior of the container and the interior of the container.

20 Claims, 4 Drawing Sheets

(56) References Cited

U.S. PATENT DOCUMENTS

| | | | | |
|---|---|---|---|---|
| 2,999,500 | A * | 9/1961 | Schurer | 604/322 |
| 3,018,813 | A | 1/1962 | Koch et al. | |
| 3,072,296 | A * | 1/1963 | Isreeli | 222/132 |
| 3,178,075 | A * | 4/1965 | Riedl et al. | 222/386.5 |
| 3,211,349 | A | 10/1965 | Prussian et al. | |
| 3,343,701 | A | 9/1967 | Mahoney | |
| 3,456,647 | A | 7/1969 | Wada | |
| 3,495,622 | A | 2/1970 | Rose | |
| 3,584,770 | A | 6/1971 | Taylor | |
| 3,672,533 | A | 6/1972 | McKean | |
| 3,724,521 | A | 4/1973 | Coddington et al. | |
| 3,834,570 | A * | 9/1974 | Barr | 215/11.3 |
| 3,937,358 | A | 2/1976 | Smith et al. | |
| 3,968,897 | A | 7/1976 | Rodgers | |
| 4,120,414 | A | 10/1978 | Harrison et al. | |
| 4,211,115 | A | 7/1980 | Engebreth | |
| 4,279,363 | A * | 7/1981 | Alikhan | 222/94 |
| 4,392,578 | A | 7/1983 | Fipp et al. | |
| 4,412,633 | A | 11/1983 | Guerrazzi et al. | |
| 4,592,492 | A * | 6/1986 | Tidmore | 222/209 |
| 4,684,033 | A | 8/1987 | Marcus | |
| 4,722,463 | A | 2/1988 | Anderson | |
| 4,809,884 | A * | 3/1989 | Stackhouse | 222/153.04 |
| 4,869,402 | A | 9/1989 | Ash, Jr. | |
| 4,881,666 | A * | 11/1989 | Tullman et al. | 222/386.5 |
| 4,923,098 | A | 5/1990 | Schoonover et al. | |
| 4,940,152 | A | 7/1990 | Lin | |
| 4,967,922 | A | 11/1990 | Alder | |
| 4,976,381 | A | 12/1990 | Scholle et al. | |
| 5,086,950 | A * | 2/1992 | Crossdale et al. | 222/88 |
| 5,118,015 | A | 6/1992 | Scholle et al. | |
| 5,176,764 | A | 1/1993 | Abbott et al. | |
| 5,248,064 | A | 9/1993 | Claycomb, Jr. | |
| 5,433,346 | A | 7/1995 | Howe | |
| 5,460,285 | A | 10/1995 | Harding, Sr. | |
| 5,653,943 | A | 8/1997 | Arnold | |
| 5,887,766 | A | 3/1999 | Yang | |
| 5,901,867 | A | 5/1999 | Mattson | |
| 6,454,137 | B1 | 9/2002 | Sturk | |
| 6,619,499 | B1 | 9/2003 | Lin | |
| 6,732,877 | B2 | 5/2004 | Wu et al. | |
| 6,732,878 | B2 | 5/2004 | Gillen | |
| 6,833,072 | B1 | 12/2004 | Krestine et al. | |
| 6,939,328 | B2 | 9/2005 | Raulerson | |
| 7,051,901 | B2 | 5/2006 | Hickert | |
| 7,086,548 | B2 | 8/2006 | Bartlett | |
| 7,201,287 | B2 | 4/2007 | Maenke | |
| 7,308,903 | B2 | 12/2007 | Rooker et al. | |
| 7,357,266 | B2 | 4/2008 | Giblin et al. | |
| 7,395,949 | B2 | 7/2008 | Ehret et al. | |
| 8,206,367 | B2 * | 6/2012 | Warren et al. | 604/414 |
| 8,267,913 | B2 * | 9/2012 | Fangrow | 604/414 |
| 2002/0017293 | A1 * | 2/2002 | Scheuch et al. | 128/200.22 |
| 2004/0108340 | A1 | 6/2004 | Witt | |
| 2005/0145634 | A1 | 7/2005 | Giblin et al. | |
| 2007/0023461 | A1 | 2/2007 | Christian et al. | |
| 2007/0205230 | A1 | 9/2007 | Arcuri et al. | |
| 2007/0244456 | A1 * | 10/2007 | Fangrow | 604/411 |
| 2007/0251913 | A1 | 11/2007 | Mengeu | |
| 2008/0110501 | A1 | 5/2008 | Penno et al. | |
| 2008/0161770 | A1 * | 7/2008 | Fangrow | 604/411 |
| 2008/0249498 | A1 * | 10/2008 | Fangrow | 604/411 |
| 2010/0049157 | A1 * | 2/2010 | Fangrow | 604/407 |
| 2014/0124528 | A1 * | 5/2014 | Fangrow | 222/1 |
| 2014/0174596 | A1 * | 6/2014 | Lopez et al. | 141/10 |

FOREIGN PATENT DOCUMENTS

| | | |
|---|---|---|
| EP | 1647499 | 4/2006 |
| GB | 1027147 | 4/1966 |
| GB | 2202836 | 10/1988 |
| GB | 2220408 | 1/1990 |
| JP | S53/98040 | 8/1978 |
| JP | 10114355 | 5/1998 |
| JP | 2008296981 | 12/2008 |
| KR | 1019990074986 | 10/1999 |
| KR | 20000000143 | 1/2000 |
| KR | 20040097087 | 11/2004 |
| WO | 9109244 | 6/1991 |

OTHER PUBLICATIONS

EP11754093.0 Extended European Search Report dated Dec. 23, 2014 (7 pages).

* cited by examiner

LIQUID DISPENSNG CONTAINER AND METHOD

CROSS-REFERENCE TO RELATED APPLICATIONS

This application is a continuation of U.S. patent application Ser. No. 13/574,728, filed Aug. 8, 2012, which is a U.S. national phase application filing of International Patent Application No. PCT/US2011/023223, filed Jan. 31, 2011, which claims the benefit of and priority to U.S. Provisional Patent Application No. 61/300,754, filed Feb. 2, 2010, the entire contents of each of which are incorporated herein by reference.

BACKGROUND

Rigid and semi-rigid liquid dispensing containers provide a convenient and cost effective way to dispense liquids, including caustic or liquid detergents, cleaning solutions, and other chemicals. One disadvantage of rigid or semi-rigid containers is that when liquid is dispensed, a vacuum can build in the container, which can cause one or more walls of the container to buckle or collapse. In some cases, the vacuum can also or instead limit or prevent liquid from properly dispensing from the container. In order to prevent a vacuum from forming as just described, air may be allowed into the container, such as when a volume of liquid is dispensed.

A cost effective way to allow air into the container is to provide a vent in a dispensing cap of the container. The vent typically comprises a one-way air valve permitting air to enter the container under sufficient vacuum, yet closing under all other conditions. However, such vents can be disabled from performing their air intake function in some orientations of the container. For example, in those container orientations in which a significant head of liquid is located over the air valve of the vent, the resulting head pressure can press the valve closed. Solutions to this problem include providing the valve with a pre-load to counter the force of the head pressure. However, as the amount of liquid in the container decreases, or as the orientation of the container changes, the head pressure can vary significantly, which can make conventional air vents prone to leakage. Another disadvantage of many air vents used for liquid containers is that elastomer components used in the valves of such vents can degrade and leak over time due to contact with contents of the container.

Based upon these and other limitations of conventional liquid container air vents and dispensing containers having such vents, improved air vents for liquid dispensing containers continue to be welcome in the art.

SUMMARY

In some embodiments, a vent is provided for a dispensing cap of a liquid dispensing container, where the vent is coupled to a deploying balloon. When liquid is dispensed from the container, the deploying balloon allows air into the container. In some embodiments, the balloon has one or more apertures therethrough in order to provide fluid communication between an exterior of the container and an interior air pocket within the container through the aperture(s). These apertures can be open to provide such fluid communication in all states of the balloon (i.e., deployed, partially deployed, and undeployed states), or can instead be open only in a fully deployed state of the balloon. In some orientations of the container, the deploying balloon can close, thereby preventing liquid from leaking out of the vent. The deploying balloon can also be temporarily contained in a sheathe that dissolves upon contact with the liquid in the container.

Some embodiments of the present invention provide a liquid dispenser including a container having an interior adapted to support a fluid, an air vent coupled to the container, and a balloon disposed in the container and in fluid communication with the air vent to provide selective fluid communication between the interior and an exterior of the container. The balloon is movable from an undeployed state to a deployed state in response to a pressure change between the interior and the exterior of the container. The balloon in the undeployed state is incapable of fluid communication between the interior and the exterior of the container, and the balloon in the deployed state has a position in which the balloon establishes fluid communication between the exterior of the container and the interior of the container.

Some embodiments of the present invention provide a liquid dispenser including a container that has an interior defining an air space and adapted to support a fluid, a balloon disposed in the container and movable from an undeployed state to a deployed state to provide fluid communication between the air space and an exterior of the container, and a sheathe encasing the balloon to maintain the balloon in the undeployed state.

In some embodiments, the present invention provides a liquid dispensing container including a container that has an interior defining an air space and adapted to support a fluid, a vent coupled to the container, and a balloon disposed in the container and in fluid communication with the vent to provide fluid communication between the interior and an exterior of the container. The balloon is movable from an undeployed state to a deployed state, and the balloon has an aperture located adjacent a distal end of the balloon and in fluid communication with the air pocket when the balloon is in the deployed state.

In another aspect, the present invention provides a liquid dispenser including a container having an interior adapted to hold a fluid, an air vent coupled to the container, and a balloon disposed in the container and in fluid communication with the air vent to provide selective fluid communication between the interior and an exterior of the container, the balloon movable from an undeployed state to a deployed state, and the balloon in the deployed state having a position in which the balloon establishes fluid communication between the exterior of the container and the interior of the container.

In another aspect, the present invention provides a liquid dispenser including a container having an interior defining a space adapted to hold a fluid, and a balloon disposed in the container and movable from an undeployed state to a deployed state to provide fluid communication between the space and an exterior of the container, wherein the balloon is deflated in the undeployed state.

In another aspect, the present invention provides a liquid dispenser including a container having an interior defining an air space and adapted to hold a fluid, and a balloon disposed in the container and movable from an undeployed state to a deployed state to provide fluid communication between the space and an exterior of the container. The balloon has a compact form in the undeployed state, and the balloon is extended in the deployed state to provide airflow communication between the air space and an exterior of the container.

Other aspects of the present invention will become apparent by consideration of the description and accompanying drawings.

DRAWINGS

FIG. 1 is a sectional side view of a liquid dispensing container including a deploying balloon attached to a vent and in an undeployed state.

FIG. 1*a* is a magnified view of the deploying balloon, taken along the broken line identified as FIG. 1*a* of FIG. 1, and illustrating the deploying balloon in an undeployed state.

Figure 3:
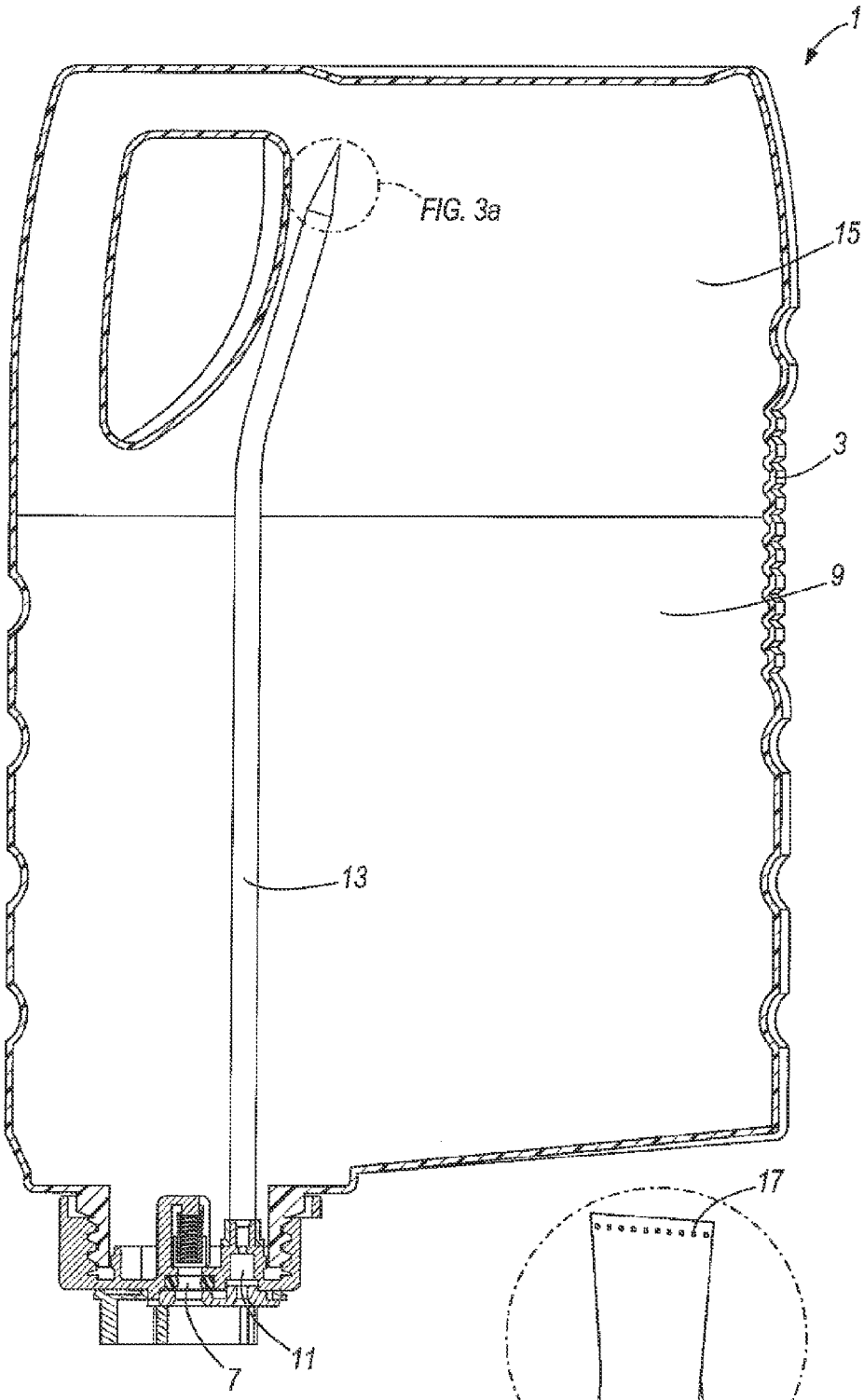
FIG. 3 is a sectional side view of a liquid dispensing container illustrated in FIGS. 1 and 2, shown with the deploying balloon in a deployed state.
Figure 3A:
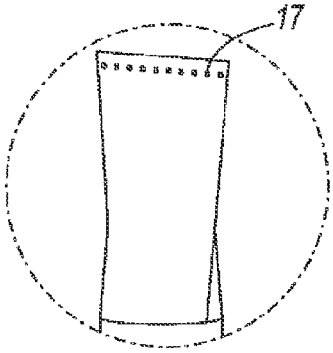

FIG. 3*a* is a magnified view of the deploying balloon, taken along the broken line identified as FIG. 3*a* of FIG. 3, and illustrating the deploying balloon in a deployed state.

Figures 1, 1A:
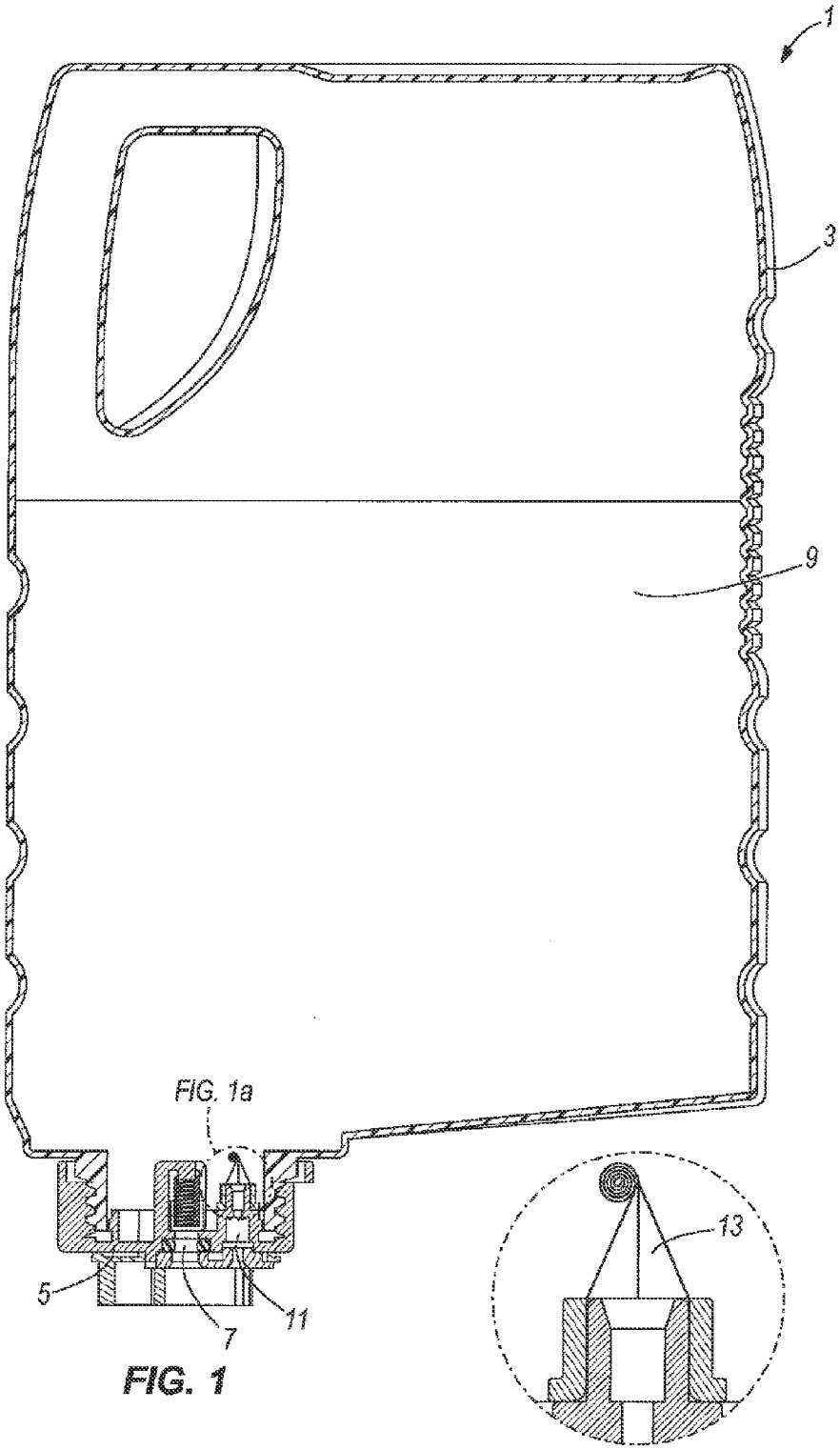
Figure 2:
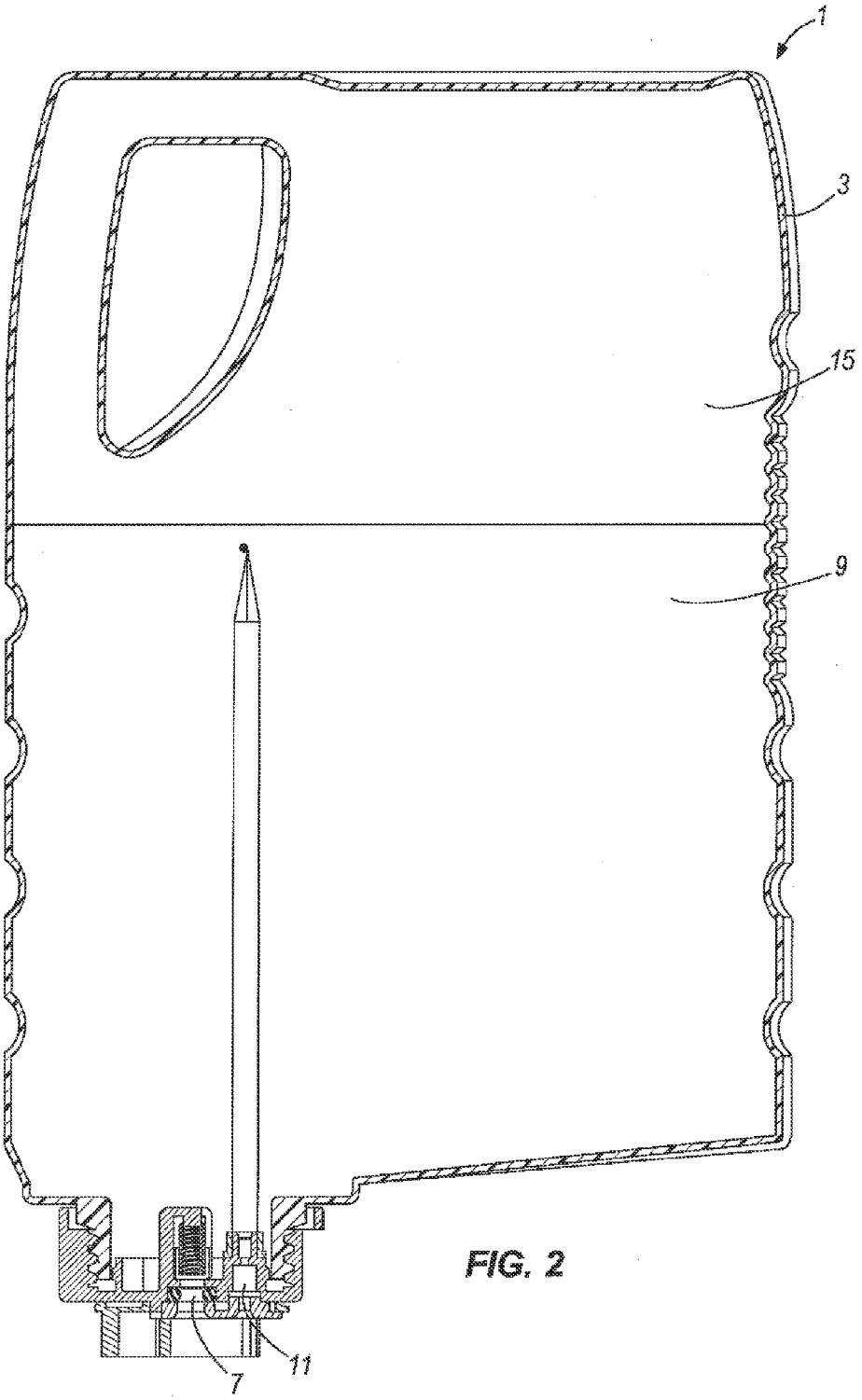
FIG. 2 is a sectional side view of the liquid dispensing container illustrated in FIG. 1, shown with the deploying balloon inflated to a partially deployed state.
Figure 4:
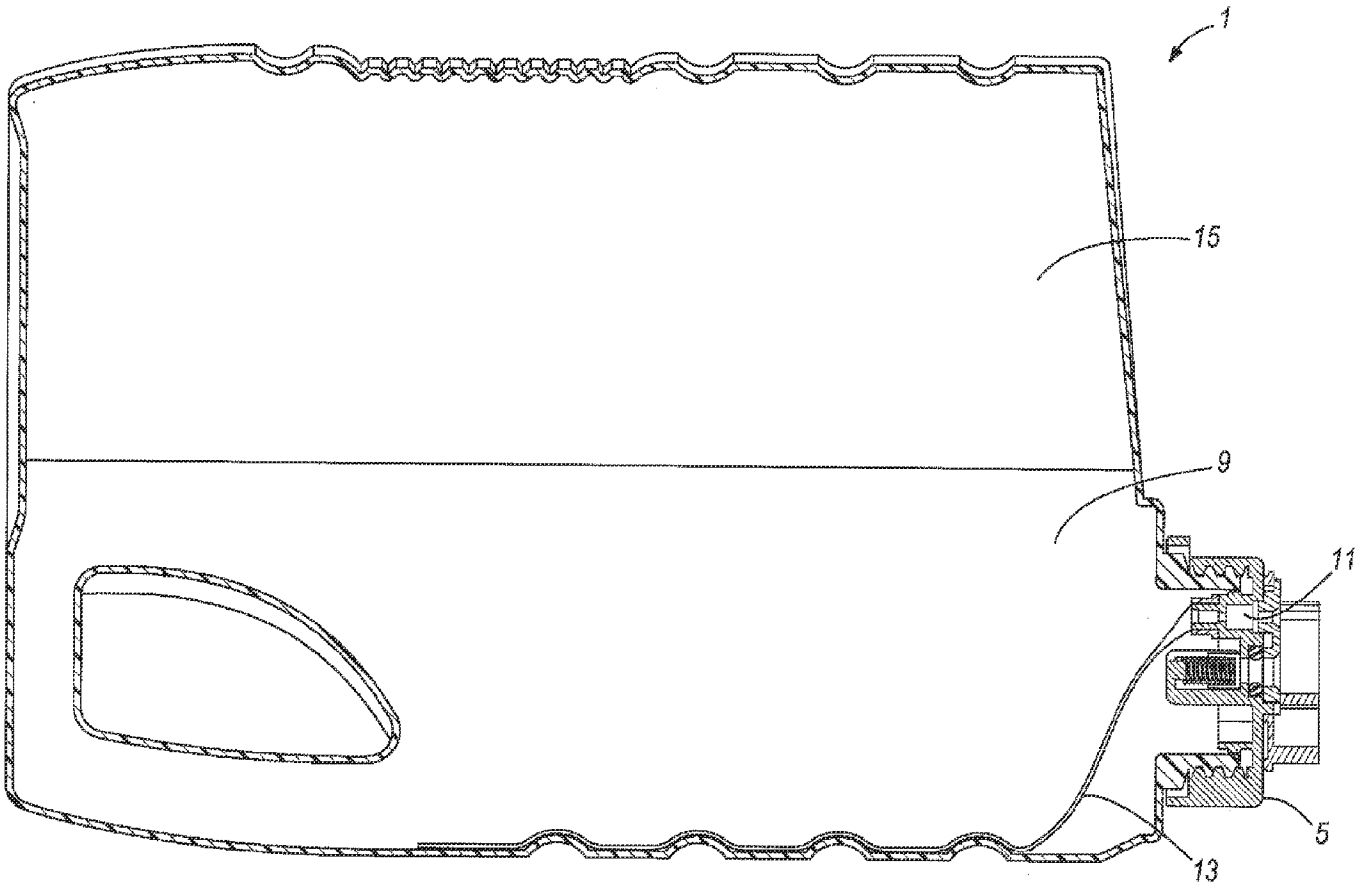

FIG. 4 is a sectional side view of the liquid dispensing container illustrated in FIGS. 1-3, shown with the container oriented on its side with the deploying balloon collapsed.

DETAILED DESCRIPTION

Before any embodiments of the present invention are explained in detail, it is to be understood that the invention is not limited in its application to the details of construction and the arrangement of components set forth in the following description or illustrated in the accompanying drawings.

FIG. 1 illustrates a liquid dispensing container 1 comprising a container 3 and a dispensing cap 5. The illustrated container 3 can have any shape and size desired, and is shown in the figures as having a somewhat rectangular elongated cross-sectional shape by way of example only. The container 3 can be constructed of any rigid or semi-rigid material desired (of course, being chemically compatible with the intended liquid contents of the container 3 in order to prevent degradation of the container 3). For example, the container 3 can be constructed of plastic, metal, glass, fiberglass, composite material, and the like. By virtue of the material and construction of the illustrated container 3, the container 3 is self supporting either when empty or when filled with liquid. However, in other embodiments, the container 3 is not necessarily self-supporting in all (or even any) of these states, such as containers 3 made of bag material or other pliable material, or containers 3 having wall thicknesses insufficient to support themselves and/or an additional load. In such embodiments, the container 3 can be provided with a box, frame, housing, or other rigid or semi-rigid support retaining the container 3 in any orientation desired.

The dispensing cap 5 of the illustrated container 3 includes a valve 7 for dispensing a liquid 9 within the container, and additionally includes a vent 11 for passage of air into the container 3 from the outside environment. The valve 7 can be spring-loaded as shown in the illustrated embodiment, or can have any other arrangement desired.

With continued reference to FIGS. 1-4, the liquid dispensing container 1 also has a deploying balloon 13 coupled to the vent 11, located within the container 3, and having an interior in fluid communication with the vent 11 (and therefore, to the exterior of the container 3). The balloon 13 can be constructed of any substantially flexible, deformable, collapsible, and liquid impermeable material desired, such as plastic or rubber. The material can be selected based at least in part upon the material's compatibility with the contents of the container 3.

When deployed, the balloon 13 can have any shape and size desired, and in the illustrated embodiment deploys to a relatively straight, thin, and elongated shape. In other embodiments, the balloon 13 instead deploys to a rotund, polygonal, or irregular shape. In any case, the shape of the balloon 13 in its deployed state has an inside diameter capable of maintaining fluid communication between the vent 11 and the interior of the container 3 with sufficient vacuum inside the container 3. Also, when at least partially deployed, the balloon 13 can have a length suitable for extending to and reaching an air pocket 15 within the container 3 in at least one (and in some cases, all) orientations of the container 3.

The balloon 13 illustrated in FIGS. 1-4 also has an undeployed state, as shown in FIG. 1. In the undeployed state of the illustrated embodiment, the balloon 13 is deflated and rolled upon itself into a relatively compact form. However, other undeployed balloon shapes are possible, such as a balloon 13 that is deflated and folded back and forth upon itself any number of times, a balloon 13 having a bellows or accordion shape permitting the balloon 13 to be deflated to a relatively compact size and shape, and a balloon 13 deflated and deformed (e.g., crushed, wrinkled, and the like) into a relatively compact size and shape. Other types and shapes of undeployed balloons are possible, and fall within the spirit and scope of the present invention.

In some embodiments, the balloon 13 is partially or completely covered or enclosed in a material that protects the balloon 13 from the liquid contents of the container 3, such as in cases where the liquid may be stored for a relatively long period of time. By protecting the balloon 13 in this manner, a wider range of balloon materials may be available, including balloon materials that may not be as compatible with the liquid contents of the container 3. The undeployed balloon 13 can be covered or enclosed by a number of different materials (not shown) protecting the balloon 13, including without limitation wax, paraffin, gel, paste, a thin layer of plastic, urethane, or other elastomeric material, paper or fabric that has been coated, uncoated, treated, or untreated, and the like. This material can be thin and weak enough to rupture or otherwise permit the balloon 13 to be deployed through or past the material under sufficient vacuum force within the container 3, while still protecting the balloon from the liquid 9 over long periods of time.

FIG. 2 illustrates the liquid dispensing container 1 in a state in which a portion of the liquid 9 has been dispensed from the container 3 through the valve 7. The deploying balloon 13 has deployed and partially unrolled by air entering the deploying balloon 13 through the vent 11 in response to a vacuum created in an air pocket 15 inside the container 3.

FIG. 3 illustrates the liquid dispensing container 1 in a state in which more of the liquid 9 has been dispensed from the container 3 through the valve 7. The deploying balloon 13 has completely unrolled due to air entering the deploying balloon 13 through the vent 11 in response to additional vacuum created in the air pocket 15. In this state, the deploying balloon 13 extends into the air pocket 15.

In some embodiments, the deploying balloon 13 has one or more apertures therethrough to enable air to exit the deploying balloon 13 into the interior of the container 3 in one or more states of the deploying balloon 13. The aperture(s) can be located anywhere in the balloon 13, and in some embodiments are exposed for air passage therethrough only following sufficient unrolling, unfolding, or other deployment of the balloon 13. In some embodiments, for example, the aperture(s) are exposed only upon substantially complete deployment or complete deployment of the balloon 13, such as that shown in FIG. 3. As shown in FIG. 3 by way of example only, a set of apertures 17 at the end of the deploying balloon 13 are normally covered and closed by other portions of the balloon 13 when the balloon 13 is not fully deployed, and are exposed for air passage therethrough when the balloon 13 is fully deployed. In some cases (again, with reference to FIG. 3 by way of example only), the aperture(s) 17 are exposed to the air pocket 15 (i.e., are located above the liquid level within the container 3) upon being uncovered. In other embodiments, the aperture(s) 17 can be located above and/or below the liquid level within the container 3 when the balloon 17 is fully deployed. Also in some embodiments any number of apertures 17 can be exposed in succession as the balloon 17 is inflated from its undeployed state to its deployed state.

If utilized, the apertures 17 of the balloon 17 can have any size desired, and in some embodiments are selected to maintain the balloon 17 in an inflated or partially inflated state after being partially or fully deployed, while still permitting air to escape therethrough into the container 3 under sufficient vacuum force within the container 3.

The balloon 17 in the illustrated embodiment is made of a material that, while flexible and deformable, does not stretch. That is, once the balloon 17 is fully inflated, the balloon does not expand to a larger size by stretching of the balloon material. In other embodiments, the balloon material is permitted to stretch, thereby enabling the balloon to expand to different inflated sizes.

FIG. 4 illustrates the liquid dispensing container 1 in a state in which the balloon 13 is deployed and the liquid dispensing container 1 has been set on a side so that the dispensing cap 5 is no longer at the bottom of the liquid dispenser 1. The deploying balloon 13 has deflated and collapsed by virtue of the pressure on the balloon 13 and the increased elevation of the vent 11 with respect to the liquid 9 within the container 3. The collapse of the balloon 13 helps to prevent any liquid that may have entered into the balloon 13 from exiting the vent 11—especially in embodiments in which the balloon 13 is provided with one or more apertures 17 as described above. If the liquid dispensing container 1 is repositioned so that the dispensing cap 5 is again on the bottom of the liquid dispenser 1, and more liquid 9 is dispensed through the valve 7, the balloon 13 can re-inflate and allow air to again enter the air pocket 15 in the container 3 as shown in FIGS. 2 and 3.

The embodiments of the present invention described above and illustrated in the accompanying figures are presented by way of example only, and are not intended as a limitation upon the concepts and principles of the present invention. As such, it will be appreciated by one having ordinary skill in the art that various changes in the elements and their configuration and arrangement are possible without departing from the spirit and scope of the present invention. For example, the deploying balloon 13 can take other forms, including various lengths, various shapes, and various materials. Also, the vent 11 can be fitted with a valve, such as a one-way valve permitting air to enter the balloon 13 from the outside environment, but blocking air and liquid from exiting through the vent 11 in an opposite direction.

As another example, the deploying balloon 13 can be configured such that it prevents liquid from leaking from the container 3 when the liquid dispensing container 1 is agitated above a predetermined threshold. The deploying balloon 13 can also be configured such that when the liquid dispenser 1 is agitated, air in the inflated balloon 13 is forced to exit the liquid dispenser 1 through the vent 11, or air in the balloon 13 is forced into the air pocket 15 inside the container 3.

As yet another example, the deploying balloon 13 can be made of a gas permeable/liquid impermeable material. Also, the vent 11 need not necessarily be located in a dispensing cap 5 of the liquid dispensing container 1, and can instead be located in any other structure of the liquid dispensing container 1. Accordingly, the balloon 13 can extend and be connected to vents 11 in other locations as alternatives to the dispensing cap 5.

What is claimed is:

1. A liquid dispenser, comprising:

a container having an interior defining an air space and adapted to hold a fluid;

an air vent coupled to the container; and a balloon disposed in the container and in fluid communication with the air vent to provide selective fluid communication between the air space and an exterior of the container, the balloon movable from an undeployed state to a deployed state, and the balloon in the deployed state having a position in which the balloon established fluid communication through the balloon between the exterior of the container and the air space of the container.

2. The liquid dispenser of claim 1, wherein the balloon is movable from the undeployed state to the deployed state in response to a pressure change between the interior and the exterior of the container.

3. The liquid dispenser of claim 1, wherein the balloon in the undeployed state is incapable of fluid communication between the interior and the exterior of the container.

4. The liquid dispenser of claim 1, wherein, in the undeployed state, the balloon is at least partially enclosed by a casing.

5. The liquid dispenser of claim 4, wherein the casing is dissolvable.

6. The liquid dispenser of claim 1, wherein the balloon is formed from an elastic material.

7. The liquid dispenser of claim 1, wherein the balloon is varied from the undeployed state toward the deployed state in response to a vacuum in the container.

8. The liquid dispenser of claim 7, wherein the balloon includes an aperture located adjacent a distal end of the balloon, and wherein the aperture is in fluid communication with an air pocket within the interior of the container in response to the balloon being varied from the undeployed state to permit airflow through the balloon into the container.

9. The liquid dispenser of claim 8, wherein the aperture is in direct communication with the air pocket when the balloon is in the deployed state.

10. The liquid dispenser of claim 1, wherein the balloon is collapsible in the deployed state in response to a change in an orientation of the container.

11. A liquid dispenser comprising:

a container having an interior defining an air space and adapted to hold a fluid; and a balloon disposed in the container and movable from an undeployed state to a deployed state to provide fluid communication through the balloon between the air space and an exterior of the container, wherein the balloon is deflated in the undeployed state.

12. The liquid dispenser of claim 11, wherein the balloon is rolled upon itself in the undeployed state.

13. The liquid dispenser of claim 11, wherein the balloon is at least partially folded upon itself in the undeployed state.

14. The liquid dispenser of claim 11, wherein the balloon has a bellows shape in the undeployed state.

15. The liquid dispenser of claim 11, wherein a protective material encloses at least a portion of the balloon in the undeployed state.

16. The liquid dispenser of claim 15, wherein the protective material maintains the balloon in the undeployed state until the balloon is varied from the undeployed state toward the deployed state in response to a vacuum in the container.

17. The liquid dispenser of claim 15, wherein the protective material maintains the balloon in the undeployed state until the protective material is ruptured in response to one or both of a vacuum in the container and air entering the balloon.

18. A liquid dispenser, comprising:

a container having an interior defining an air space and adapted to hold a fluid;

a balloon disposed in the container and movable from an undeployed state to a deployed state to provide fluid communication through the balloon between the air space and an exterior of the container.

wherein the balloon has a compact form in the undeployed state, and wherein the balloon is extended in the deployed state to provide air flow communication between the air space and an exterior of the container.

19. The liquid dispenser of claim 18, wherein the balloon in the undeployed state is incapable of fluid communication between the interior and the exterior of the container.

20. The liquid dispenser of claim 18, wherein the balloon is movable from the undeployed state to the deployed state in response to a pressure change between the interior and the exterior of the container.

* * * * *